US007469772B2

(12) United States Patent
Takeuchi

(10) Patent No.: US 7,469,772 B2
(45) Date of Patent: Dec. 30, 2008

(54) ELEVATOR DESTINATION FLOOR DISPLAY UNIT DISPLAYING ONLY DESTINATION FLOORS THAT HAVE BEEN SELECTED

(75) Inventor: Nobukazu Takeuchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 535 days.

(21) Appl. No.: 10/553,391

(22) PCT Filed: Apr. 30, 2004

(86) PCT No.: PCT/JP2004/006279

§ 371 (c)(1),
(2), (4) Date: Oct. 17, 2005

(87) PCT Pub. No.: WO2005/105643

PCT Pub. Date: Nov. 10, 2005

(65) Prior Publication Data

US 2006/0207836 A1 Sep. 21, 2006

(51) Int. Cl.
*B66B 1/34* (2006.01)

(52) U.S. Cl. ..... 187/396; 187/391; 187/381

(58) Field of Classification Search ..... 187/391–396, 187/380–388

See application file for complete search history.

(56) References Cited

U.S. PATENT DOCUMENTS 4,149,614 A * 4/1979 Mandel et al. ..... 187/397
6,502,668 B1 * 1/2003 Chida et al. ..... 187/395
6,997,288 B2 * 2/2006 Kakko et al. ..... 187/391
7,040,458 B2 * 5/2006 Forsythe et al. ..... 187/396
2003/0164267 A1 9/2003 Hikita

FOREIGN PATENT DOCUMENTS

| | | | |
|---|---|---|---|
| JP | 58-172168 | | 10/1983 |
| JP | 59-40270 | U | 3/1984 |
| JP | 01242378 | A * | 9/1989 |
| JP | 2-86579 | | 3/1990 |
| JP | 2-225272 | | 9/1990 |
| JP | 05-043158 | | 2/1993 |
| JP | 06-191753 | | 7/1994 |
| JP | 8-59108 | | 3/1996 |
| JP | 08-175770 | | 7/1996 |
| WO | WO 3089353 | A1 * | 10/2003 |
| WO | WO 2005/077803 | | 8/2005 |

* cited by examiner

*Primary Examiner*—Jonathan Salata
(74) *Attorney, Agent, or Firm*—Leydig, Voit & Mayer, Ltd.

(57) ABSTRACT

An elevator destination floor display unit is installed in an elevator boarding area or an elevator car. The elevator destination floor display unit has a display portion having a screen selectively displaying destination floor representations relating to all floors, and a display control portion which arranges and displays, in a matrix form, only destination floor representations of destination floors registered on the screen. Therefore, the unit decreases the area of the required display space, makes it possible to visually recognize destination floor representations with ease, and possesses a high degree of freedom for installation.

8 Claims, 9 Drawing Sheets

ELEVATOR DESTINATION FLOOR DISPLAY UNIT DISPLAYING ONLY DESTINATION FLOORS THAT HAVE BEEN SELECTED

TECHNICAL FIELD

The present invention relates to an elevator destination floor display unit that provides guidance by displaying a destination floor registered by means of a destination floor selection button.

BACKGROUND ART

In a conventional elevator operating panel, as disclosed in JP HEI 6-191753 A, operation buttons for registering destination floors are displayed in fixed positions on a display having a touch panel disposed on a front face thereof. When a passenger touches the touch panel, a destination floor is registered. In addition, when a color of an operation button disposed in the touch panel changes, the passenger knows that the destination floor whose color has been changed is a registered floor. Consequently, operability similar to that of mechanical buttons is achieved.

However, the operation buttons are arranged in the fixed display positions, and the operation buttons for all floors are displayed. Therefore, as in the case of the mechanical buttons, when the number of floors where an elevator stops increases, the operation buttons that have increased in number cannot be easily displayed on a display with a suitable size. An attempt to display more floors where the elevator stops causes a problem of an excessive increase in the size of the display. Further, the fact that, there are a large number of floors where the elevator stops brings about a problem in that passengers cannot easily locate displayed destination floors.

Further, as disclosed in JP HEI 5-43158 A, registered floors are displayed on a digital indicator in accordance with a sequence of floor numbers. Since the registered floors are displayed along a longitudinal column sequentially from a top section thereof, a problem emerges as for limitations to the installation position of the digital indicator.

Further, as disclosed in JP HEI 8-175770 A, there is proposed a call registration unit in which call registration is carried out using numeric keys and registered floors are displayed using an indicator. Since the numeric keys for registration are separated from the display indicator, a wide installation area is required to arrange those separate components. Moreover, increased cost problems arise.

It is an object of the present invention to provide an elevator destination floor display unit that requires a small display area, makes it possible to visually recognize destination floors easily, and has a high degree of freedom for installation.

DISCLOSURE OF THE INVENTION

An elevator destination floor display unit according to the present invention installed in a boarding area or in a passenger car of an elevator including a display portion having a screen capable of selectively displaying destination floor representations related to all floors and a display control portion that arranges and displays in a matrix form, only destination floor representations of destination floors registered on the screen.

As regards the effects of the elevator destination floor display unit thus constructed, since only destination floor representations of registered destination floors are displayed, the required area of the screen for displaying the destination floor representations can be reduced, and since the number of displayed destination floor representations is less, passengers can easily confirm registered destination floors.

BEST MODES FOR CARRYING OUT THE INVENTION

Embodiment 1

Figure 1:
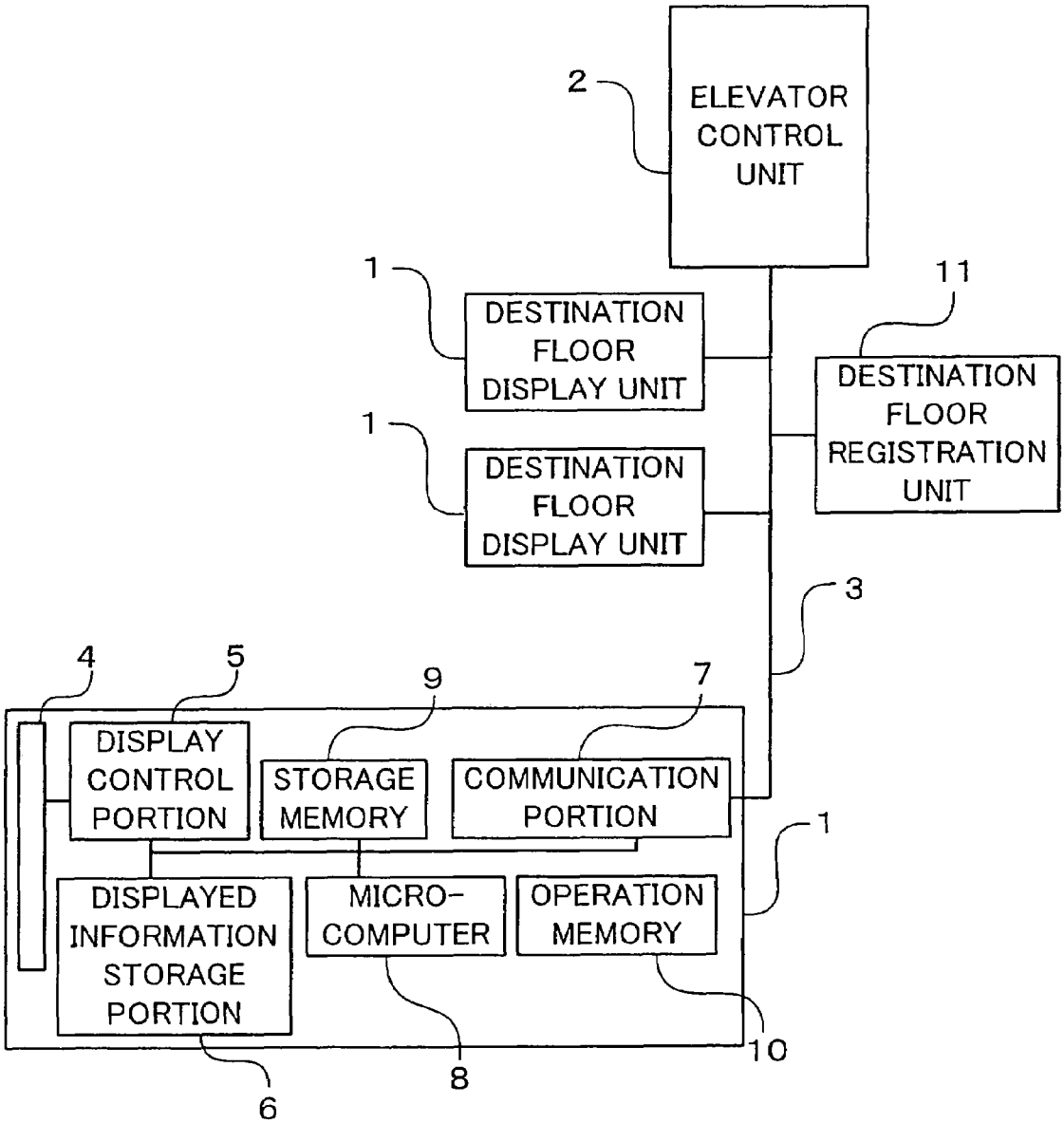
FIG. 1 is an overall schematic diagram of an elevator destination floor display unit according to Embodiment 1 of the present invention.
Figure 2:
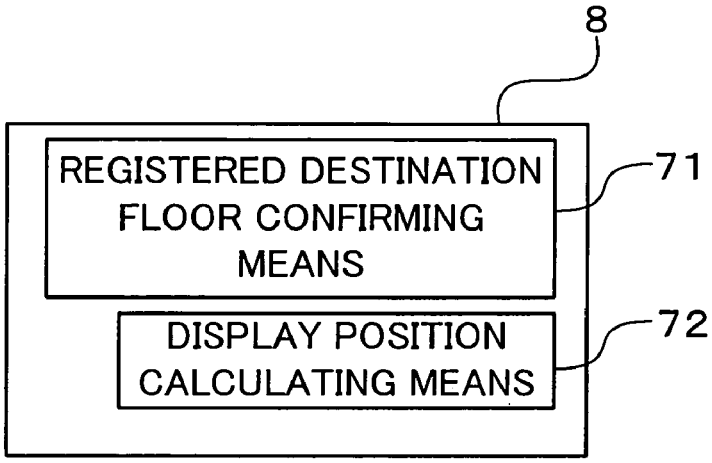
FIG. 2 is a functional block diagram of a microcomputer of the elevator destination floor display unit of Embodiment 1.
Figure 3:
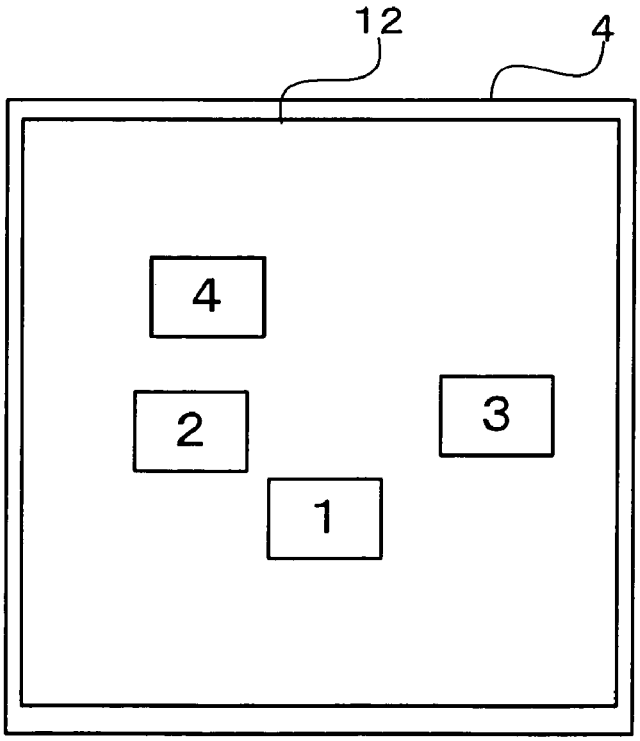
FIG. 3 is a view for explaining destination floor representations according to Embodiment 1.
Figure 4:
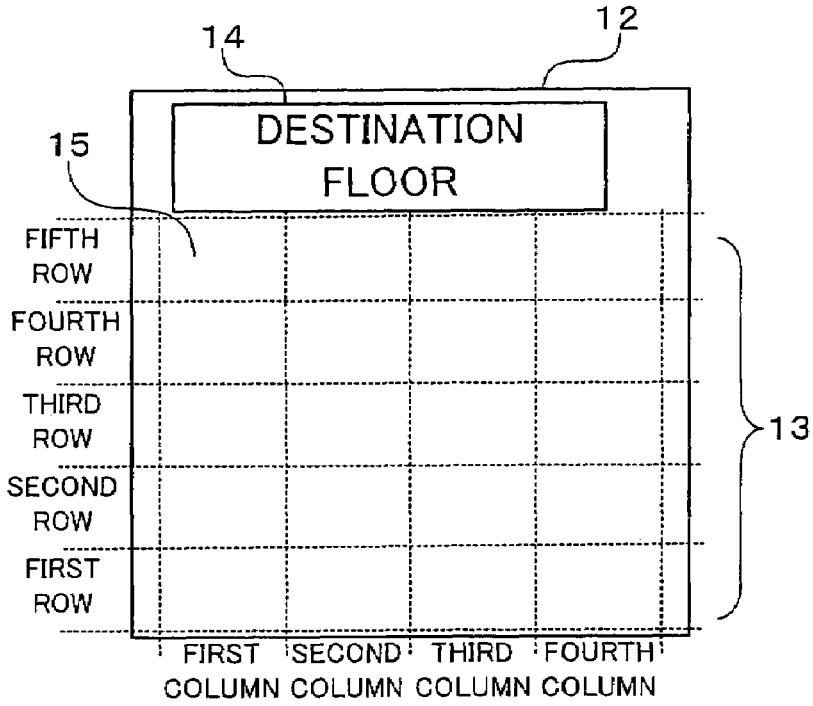
FIG. 4 is a view for explaining positions for displaying destination floor representations according to Embodiment 1.

FIG. 1 is an overall schematic diagram of an elevator destination floor display unit according to Embodiment 1 of the present invention. FIG. 2 is a functional block diagram of a microcomputer of the elevator destination floor display unit of Embodiment 1. FIG. 3 is a view for explaining destination floor representations according to Embodiment 1. FIG. 4 is a view for explaining positions for displaying destination floor representations according to Embodiment 1.

One or more elevator destination floor display units (hereinafter abbreviated as destination floor display units) 1 are installed in boarding areas and a passenger car. A plurality of destination floor display units 1 are connected via an elevator control unit 2 and a communication channel 3. The destination floor display units 1 transmit information on registration of a destination floor to the elevator control unit 2 and receive such information therefrom.

The elevator control unit 2 registers a destination floor, which is inputted by a passenger through an operation performed by a destination floor registration unit 11, as a registered destination floor, and operates the passenger car of the elevator based on the registered destination floor. In addition, the elevator control unit 2 transmits information on the registered destination floor to the destination floor display units 1 as necessary.

Each of the destination floor display units 1 has a display portion 4 on which a destination floor representation composed of a number indicating a destination floor or a graphic decorating the number is displayed, a display control portion 5 that controls display of a destination floor representation on the display portion 4, a displayed information storage portion 6 in which information on a displayed destination floor representation and information on a display position of the destination floor representation are stored, a communication portion 7 that controls communication with the elevator control unit 2, a microcomputer 8 that controls the entire destination floor display unit 1, a program storage memory 9, and a working memory 10.

The program storage memory 9, the working memory 10, and the displayed information storage portion 6 are constructed of hard disk drives, nonvolatile memories, memories requiring occasional writing and holding operations, or the like.

Alternatively, the program storage memory 9, the working memory 10, and the displayed information storage portion 6 may be constructed of any storage units or storage cells other than the aforementioned ones. Further, the program storage memory 9, the working memory 10, and the displayed information storage portion 6 may be integrated into a single unit and constructed inside a storage unit or a storage cell.

Further, the program storage memory 9, the working memory 10, the displayed information storage portion 6, the display control portion 5, and the communication portion 7 may be constructed by being built into the microcomputer 8.

As shown in FIG. 2, the microcomputer 8 has registered destination floor confirming means 71 and destination floor display position calculating means 72. The registered destination floor confirming means 71 confirms whether or not information on a newly registered destination floor is included in information on registered destination floors which is transmitted by the elevator control unit 2, or confirms whether or not information on a newly de-registered destination floor is included in information on registered destination floors. When the information on the newly registered destination floor is included, the destination floor display position calculating means 72 calculates display positions of registered destination floor representations in accordance with a predetermined sequence. Further, when the information on the newly de-registered destination floor is included, the destination floor display position calculating means 72 calculates display positions of destination floor representations of registered destination floors other than the de-registered destination floor in accordance with a predetermined sequence so that the destination floor representation of the de-registered destination floor is deleted.

As shown in FIG. 3, the display portion 4 has a screen 12 constructed as a liquid crystal display. A representation of a combination of graphics and characters can be displayed at any position on the screen 12. The destination floor display position calculating means 72 calculates the position of the representation, which is inputted to the display control portion 5. Based on information on the position of the representation, the display control portion 5 displays the representation at that position on the screen 12.

Any indicator other than the liquid crystal display, such as a plasma display, an LED, a cathode-ray tube, or the like may be used provided that, the display means is capable of displaying characters and graphics.

A representation indicating a number of a destination floor (hereinafter referred to as a destination floor representation) displayed on the screen 12 is a combination of a rectangular graphic and the number representing the destination floor. The color of the rectangular graphic is different from that of the background of the figure. The display control portion 5 displays each destination floor representation so that it does not overlap with a predetermined position on the screen 12. The position of the representation on the screen 12 can be designated by vertical and horizontal addresses.

In the following description, the destination floor representation is a representation having a number depicted inside a rectangular graphic. However, this representation is an example for explanation and the present invention is not limited thereto. For example, a number may be depicted inside a graphic such as a circle or a triangle. Further, a representation using numbers only is also acceptable.

Based on these pieces of information, the display control portion 5 displays the destination floor representation on the screen 12.

A destination floor of the elevator is registered when a passenger operates the destination floor registration unit 11 that is provided in the passenger car or in a boarding area. When the passenger presses a destination floor button of the destination floor registration unit 11 provided in the passenger car, information on the destination floor is transmitted to the elevator control unit 2. Further, when a passenger presses a call button as the destination floor registration unit 11 provided in a boarding area, information defining the boarding area as a destination floor is transmitted to the elevator control unit 2. Based on these pieces of information, the elevator control unit 2 registers a registered destination floor.

Next, a mode of displaying a destination floor representation will be described with reference to FIG. 4.

The screen 12 of the display portion 4 is divided into two regions, that is, an upper region and a lower region. The lower region shown in FIG. 4 is a destination floor display region 13, and the region above it is a message display region 14.

The destination floor display region 13 is divided into minor destination floor display regions 15 in the form of a matrix with five rows and four columns. Destination floor representations are displayed within the minor destination floor display regions 15. The matrix with five rows and four columns is mentioned as an example. An arbitrary number of rows and an arbitrary number of columns may be set according to the specification of the elevator.

Further, characters are displayed in the message display region 14. A message concerning the contents displayed in the destination floor display region 13 is displayed in the message display region 14. For example, referring to FIG. 4, the contents displayed in the destination floor display region 13 indicate "destination floor".

Figure 5:
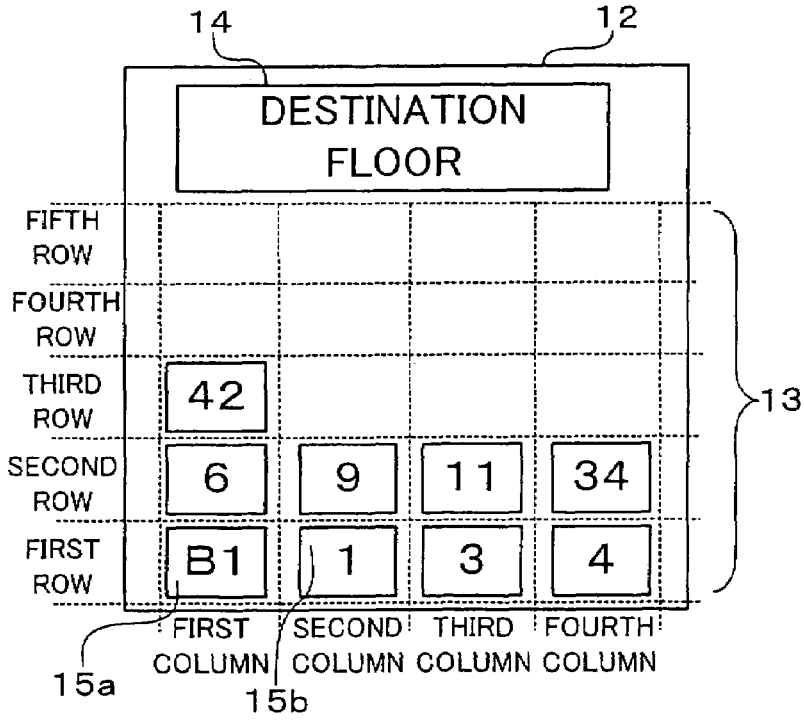
FIG. 5 is a view showing an example of destination floor representations displayed on a screen of Embodiment 1.

Next, a method of displaying destination floor representations on the destination floor display region 13 will be described with reference to FIG. 5. FIG. 5 shows how the destination floor representations are displayed on the screen.

A state in which there is no registered destination floor will be described first. A destination floor representation of a newly registered destination floor is displayed in the minor destination floor display region 15*a* in the first row and the first column. A destination floor representation of a subsequently registered destination floor is displayed in the minor destination floor display region 15*b* in the first row and the second column. At this time, if the destination floor of the destination floor representation displayed in the minor destination floor display region 15*a* in the first row and the first column is higher than a newly registered destination floor, the destination floor representation of the newly registered destination floor is displayed in the minor destination floor display region 15*a*, and the destination floor representation of the previously registered destination floor is displayed in the minor destination floor display region 15*b*. The positions of the destination floor representations are set in advance. In the example of FIG. 5, destination floor representations are sequentially displayed rightward from the first column to the fourth column in the first row. When the four minor destination floor display regions 15 in the first row are filled with destination floor representations, destination floor representations are sequentially displayed from the first column to the fourth column in the second row. In this manner, up to 20 destination floor representations are displayed.

In this example of FIG. 5, the registered destination floors are arranged in an ascending sequence according to floor numbers, and the destination floor representations are displayed in sequence according to the registered destination floors that are arranged sequentially from lower rows to upper rows. In this display, the lower a destination floor is, the lower it is displayed on the screen 12. Therefore, this display is visually more understandable to passengers. Referring to FIG. 5, for example, when the registration of floor "9" is canceled, the destination floor representations displayed to the right of and above floor "9" are moved and displayed in such a manner as to fill in the minor destination floor display region 15 where floor "9" used to be displayed.

It is also possible to start from the minor destination floor display region 15 in the lower row and the right column, namely, in the first row and the fourth column. Further, it is also possible to start from the minor destination floor display region 15 in the upper row and the left column, namely, in the fifth row and the first column. Further, it is also possible to start from the minor destination floor display region 15 in the upper row and the right column, namely, in the fifth row and the fourth column.

Further, registered destination floors may be arranged in a descending sequence according to the floor numbers, and destination floor representations may be displayed in accordance with the sequence in the minor destination floor display regions 15 in the upper rows on the screen.

Further, when the destination floor representations are permutated, it is appropriate to perform display while gradually shifting display positions, instead of immediately moving a first one of the destination floor representations to a head position after permutation.

Figure 6:
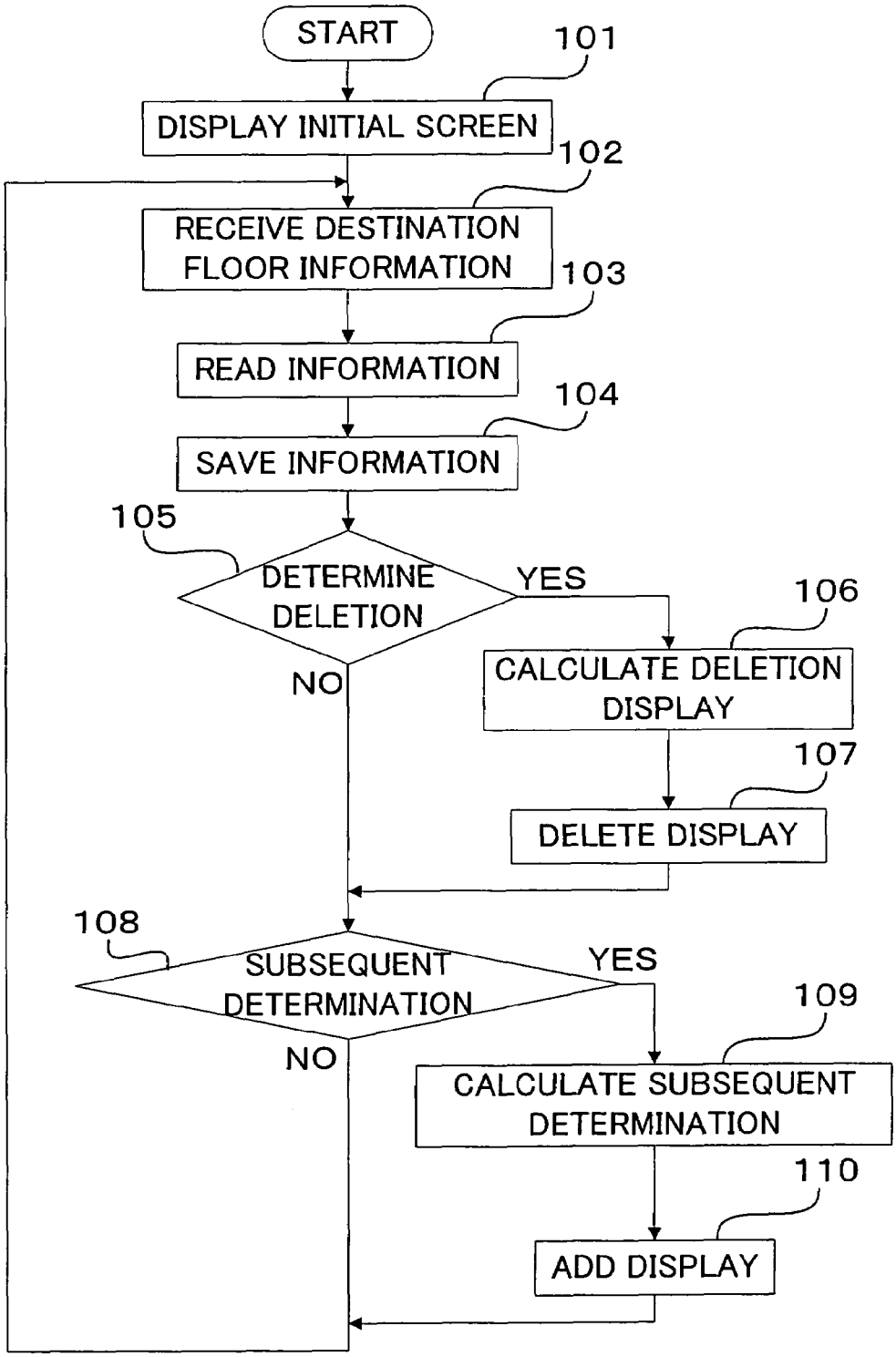
FIG. 6 is a flowchart showing the procedure of displaying a destination floor representation by means of the elevator destination floor display unit of Embodiment 1.

Next, a procedure of displaying a destination floor representation will be described with reference to FIG. 6. FIG. 6 is a flowchart showing a procedure of displaying a destination floor representation by means of the elevator destination floor display unit of Embodiment 1.

In a step 101 (displaying initial screen), the display control portion 5 displays a required initial screen such as a background screen or the like on the screen 12, upon the start of operation.

In a step 102 (receiving destination floor information), the communication portion 7 receives current registered destination floor information transmitted from the elevator control unit 2. The registered destination floor information includes information on all the floors that are currently registered as destination floors.

In a step 103 (reading of information), the registered destination floor confirming means 71 reads the last registered destination floor information stored in the working memory 10.

In a step 104 (save information), the registered destination floor confirming means 71 saves current registered destination floor information received in the step 102 into the working memory 10 as last registered destination floor information for subsequent registrations.

In a step 105 (determination on deletion), the registered destination floor confirming means 71 determines whether or not information on a de-registered destination floor is included, through a comparison between the last registered destination floor information and the current registered destination floor information, and determines whether or not it is necessary to delete a representation. When it is necessary to delete a representation, the process advances to a step 106. When it is unnecessary to delete a representation, the process advances to a step 108. Registration or cancellation of a registered destination floor is carried out, for example, when the passenger car of the elevator reaches the destination floor.

In a step 106 (calculation of deleted representation), the display position calculating means 72 calculates a position of a representation of a de-registered destination floor. Then, the display position calculating means 72 calculates display positions obtained by moving representations of the remaining registered destination floors to fill in a deleted position. However, when a position of a representation of a de-registered destination floor is the last one of a row of representations, they are not permutated.

In a step 107 (display of deletion), the display control portion 5 displays destination floor representations on the screen 12 based on the calculated display positions. Then the processing advances to the step 108.

In the step 108 (additional determination), the registered destination floor confirming means 71 determines whether or not information on a newly registered destination floor is included, through a comparison between last registered destination floor information and current registered destination floor information, and determines whether or not it is necessary to add a representation. When it is necessary to add a representation, the processing advances to a step 109. When it is unnecessary to add a representation, the processing returns to the step 102.

In the step 109 (calculation of additional representation), the display position calculating means 72 calculates a position of an additional representation so that destination floors including newly registered destination floors are arranged in an ascending sequence according to floor numbers.

In a step 110 (additional display), the display control portion 5 additionally displays a destination floor representation on the screen 12 based on the requested display position. After this display is completed, the processing returns to the step 102.

With the destination floor display unit thus constructed, only destination floor representations of currently registered destination floors are arranged and displayed in a matrix form. Therefore, destination floors can be displayed on a screen with a small area, and passengers can easily confirm representations of registered destination floors. Thus, no problem is practically caused even in the case where only destination floor representations of registered destination floors are displayed on a display screen having a reduced area. This is because even in the case of an elevator with a large number of floors, there is a limit to the number of passengers carried in a car of the elevator, and because the ability to display destination floor representations of destination floors that are approximately equal in number to the passengers suffices.

In this display of the destination floor representations, the procedure in which the communication portion 7 receives registered destination floor information from the elevator control unit 2 and the procedure of displaying the destination floor representations can be carried out independently of each other. Therefore, these procedures may be carried out asynchronously in parallel with each other.

Embodiment 2

Figure 7:
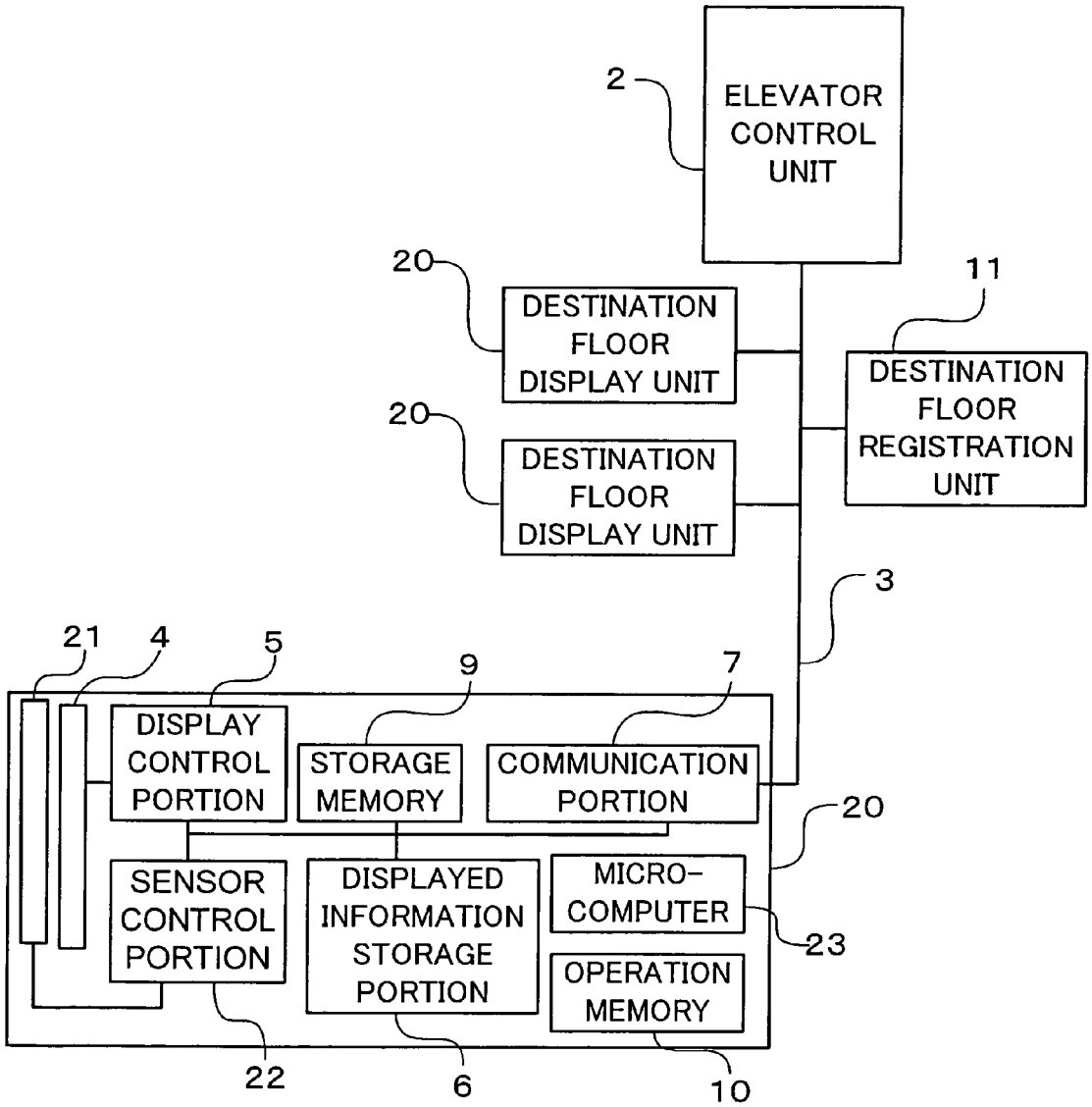
FIG. 7 is an overall block diagram of an elevator destination floor display unit according to Embodiment 2 of the present invention.
Figure 8:
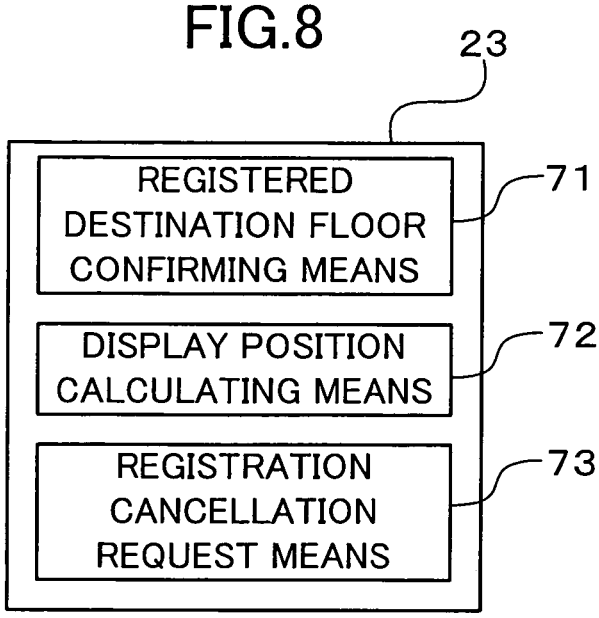
FIG. 8 is a functional block diagram of a microcomputer of the elevator destination floor display unit of Embodiment 2.
Figure 9:
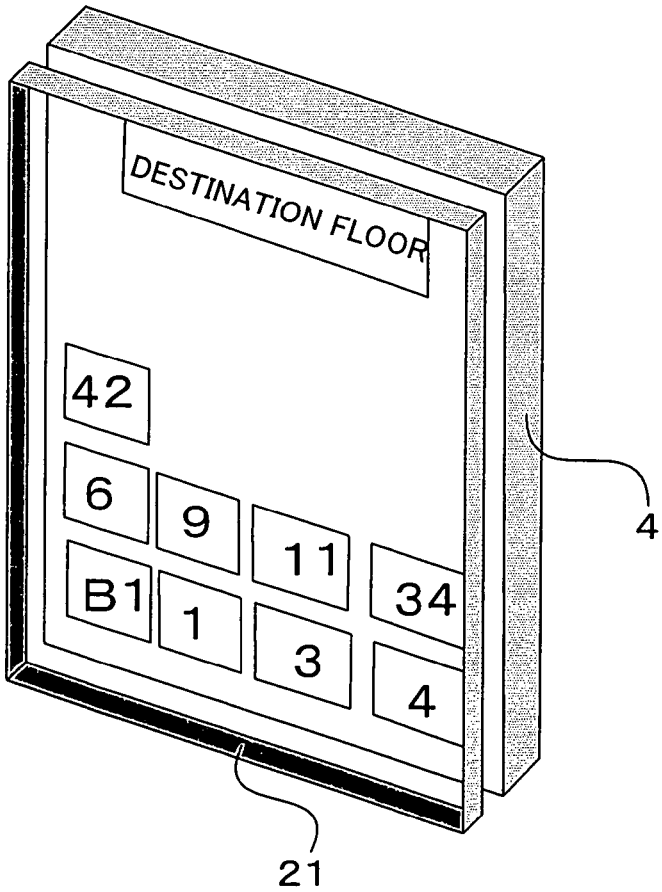
FIG. 9 is a perspective view showing a display portion and a touch panel sensor of FIG. 7.
Figure 10:
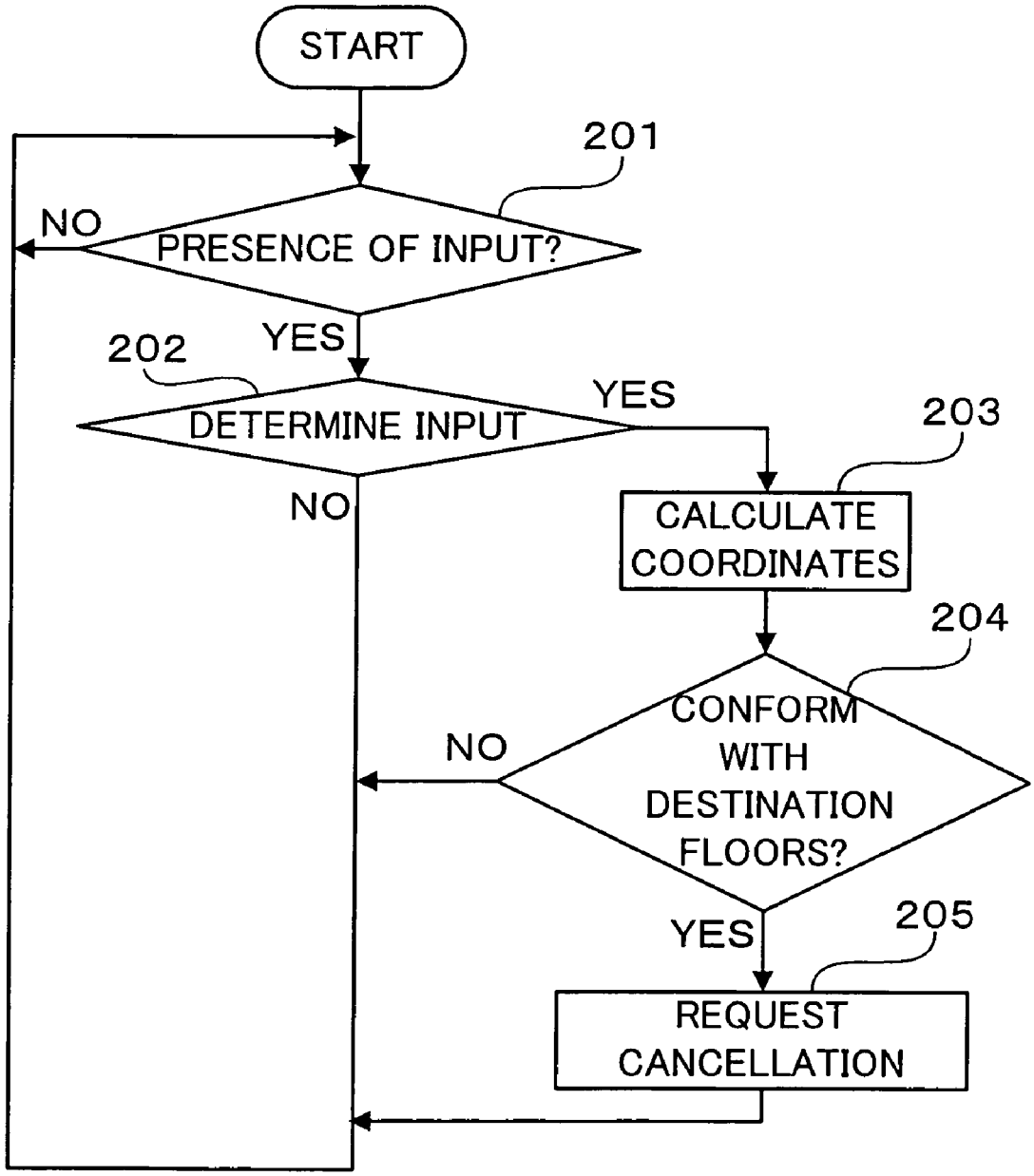
FIG. 10 is a flowchart showing a procedure of canceling destination floor registration in Embodiment 2.

FIG. 7 is an overall schematic diagram of an elevator destination floor display unit according to Embodiment 2 of the present invention. FIG. 8 is a functional block diagram of a microcomputer of the elevator destination floor display unit of Embodiment 2. FIG. 9 is a perspective view showing a display portion and a touch panel sensor of FIG. 7. FIG. 10 is a flowchart showing the procedure of canceling registration of a destination floor in Embodiment 2.

A destination floor display unit 20 of Embodiment 2 is different from the destination floor display unit 1 of Embodiment 1 in that a touch panel sensor 21 and a sensor control portion 22 for controlling the touch panel sensor 21 are added thereto. Further, as shown in FIG. 8, a microcomputer 23 has registration cancellation request means 73 for requesting the elevator control unit 2 to cancel the registration of a registered destination floor relating to a destination floor representation selected by touching the touch panel sensor 21. Since the destination floor display unit 20 of Embodiment 2 is similar to the destination floor display unit 1 of Embodiment 1 in other respects, similar components will be denoted by the same reference numerals and will not be described.

As shown in FIG. 9, the touch panel sensor 21 is provided so it abuts the external side of the display portion 4. The touch panel sensor 21 transmits a signal relating to a contact position, touched by a passenger, to the sensor control portion 22.

The sensor control portion 22 transmits contact coordinates of the touch panel sensor 21 to the microcomputer, based on the signal relating to the contact position.

The registration cancellation request means 73 specifies a destination floor from a display position of a destination floor representation or from contact coordinates, determines that the passenger is trying to cancel a registration of a registered destination floor, and requests the elevator control unit 2 to cancel registration of the registered destination floor.

The elevator control unit 2 cancels registration of the registered destination floor, updates registered destination floor information according to the request, and then transmits the registered destination floor information back to the destination floor display unit 20.

The destination floor display unit 20 deletes a relevant destination floor representation as is the case with Embodiment 1.

Next, a procedure of canceling registration of a registered destination floor will be described with reference to FIG. 10. FIG. 10 is a flowchart showing a procedure of canceling a registration of a registered destination floor. An example in which it is determined that a request to cancel a registration is valid when the touch panel sensor 21 is touched twice intermittently will be described in this procedure. However, it is also appropriate to determine that a request to cancel a registration is valid even when the touch panel sensor 21 is touched only once.

In a step 201 (the presence of input), the sensor control portion 22 detects an operation input from the touch panel sensor 21 and thereby makes a determination on the presence or absence of an operation input. When there is an operation input, the processing advances to a step 202. When there is no operation input, the processing returns to the step 201.

In a step 202 (determine input), the registration cancellation request means 73 determines whether or not there was an operation input within a predetermined time prior to a current operation input. If there is no operation input before, the processing returns to the step 202. If there is an operation input, the processing advances to a step 203. If there are two intermittent operation inputs, it is determined that, an operation input relating to a request to cancel a registration is valid. If there is one operation input only, it is determined that the operation input relating to the request to cancel registration is an operation input inputted erroneously.

In the step the 203 (calculation of coordinates), the registration cancellation request means 73 obtains contact coordinates touched for the current operation input and the previous operation input respectively, from the sensor control portion 22.

In a step 204 (conform with destination floors), the registration cancellation request means 73 specifies destination floor representations displayed on the respective contact coordinates from the current contact coordinates and the previous contact coordinates. The registration cancellation request means 73 then determines whether or not the destination floor representations are identical to each other. When the destination floor representations are identical to each other, a transition to a step 205 is made. When the destination floor representations are different from each other, the contact coordinates touched for the current operation input are stored into the working memory 10, the processing returns to the step 201.

In the step 205 (request for cancellation), the registration cancellation request means 73 determines that the current operation input is a request to cancel a registration of a registered destination floor, and transmits a request to cancel registration to the elevator control unit 2 via the communication portion 7. Then, the processing returns to the step 201.

After receiving the request to cancel the registration, the elevator control unit 2 cancels the registration of the registered destination floor whose cancellation is requested, updates registered destination floor information, and transmits the updated registered destination floor information to the destination floor display unit 20.

Based on the updated registered destination floor information, each destination floor display unit 20 deletes a destination floor representation of a destination floor whose registration is canceled (see the steps 105 to 107 of FIG. 6).

The destination floor display unit thus constructed can cancel registration of an erroneously registered destination floor, and therefore, can reduce the number of times of unnecessary stoppage of the elevator, can enhance the efficiency of transportation, and can shorten the traveling time.

Further, since a registration of a registered destination floor is not regarded as having been canceled unless the touch panel sensor 21 is touched twice, the registration of the registered destination floor is not canceled even when the touch panel sensor 21 is erroneously touched only once.

Embodiment 3

Figure 11:
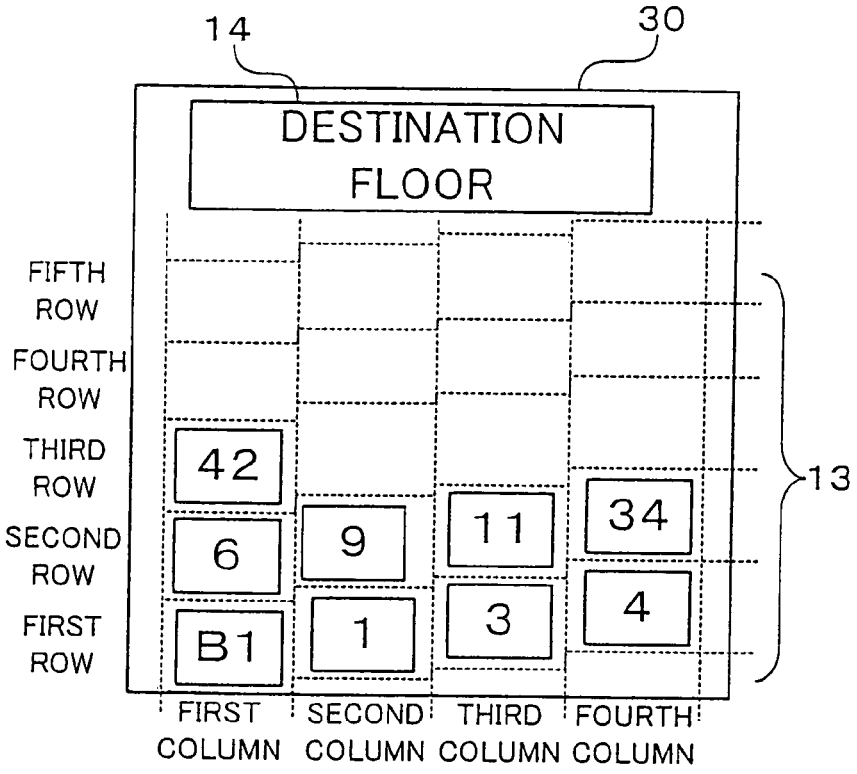
FIG. 11 is a view showing an example of destination floor representations displayed on a screen of Embodiment 3 of the present invention.

FIG. 11 is a view showing destination floor representations displayed on a screen of a destination floor display unit according to Embodiment 3 of the present invention. The destination floor display unit of Embodiment 3 is different from the destination floor display unit 1 of Embodiment 1 in the positions of destination floor representations displayed on the screen. Since the destination floor display unit of Embodiment 3 is similar to the destination floor display unit 1 of Embodiment 1 in other respects, similar components will be denoted by the same reference numerals and will not be described.

As shown in FIG. 11, destination floor representations of registered destination floors are arranged and displayed on a screen 30 according to Embodiment 3 in five rows and four columns, as is the case with Embodiment 1. However, the destination floor representations displayed in each row are displayed stepwise in such a manner as to gradually shift upward from the first column to the fourth column.

In the destination floor display unit thus constructed, the destination floor representations are displayed with their display positions shifted stepwise. Thus, the impression of an up-and-down relationship among the destination floors is strengthened, and visibility of the destination floors is improved.

Embodiment 4

Figure 12:
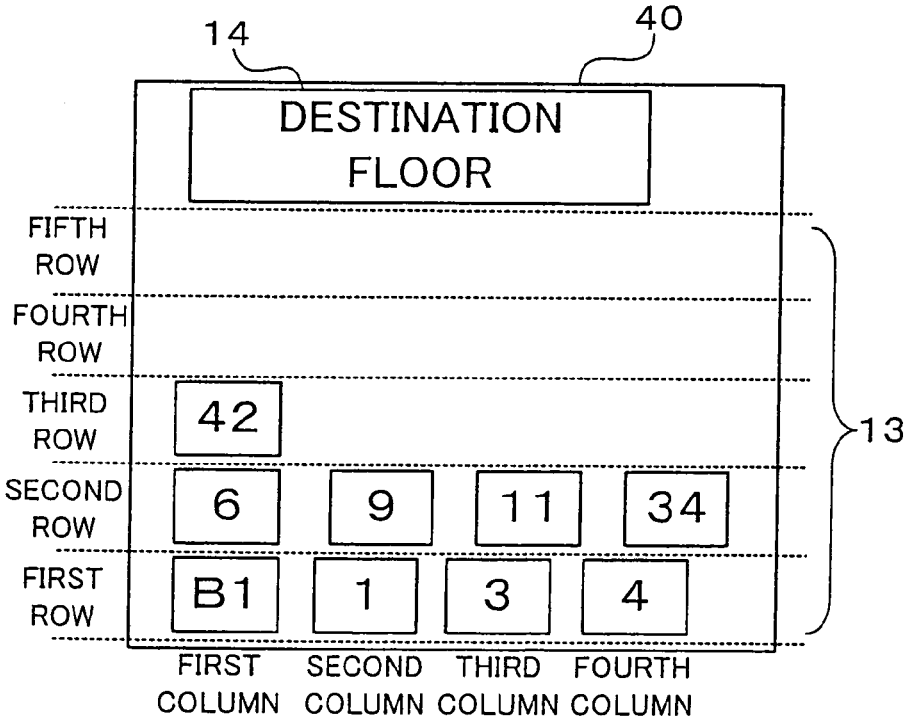
FIG. 12 is a view showing an example of destination floor representations displayed on a screen of Embodiment 4 of the present invention.

FIG. 12 is a view showing destination floor representations displayed on a screen of a destination floor display unit according to Embodiment 4 of the present invention. The destination floor display unit of Embodiment 4 is different from the destination floor display unit 1 of Embodiment 1 in the positions of destination floor representations displayed on the screen. Since the destination floor display unit of Embodiment 4 is similar to the destination floor display unit 1 of Embodiment 1 in other respects, similar components will be denoted by the same reference numerals and will not be described.

As shown in FIG. 12, destination floor representations are arranged and displayed on a screen 40 according to Embodiment 4 in five rows and four columns, as is the case with Embodiment 1. However, respective adjacent destination floor representations are displayed with the width of the gap therebetween changing depending on whether or not destination floors of the respective adjacent destination floor representations are close to each other. The gap is narrow when they are close to each other, and wide when they are far from each other. For example, as shown in FIG. 12, since floor "B1" and floor "1" are adjacent to each other and floor "3" and floor "4" are adjacent to each other, the gaps between those respective floors are the narrowest. On the other hand, since floor "6" and floor "9" are far from each other and floor "11" and floor "34" are far from each other, the gaps between those respective floors are wide.

In the destination floor display unit thus constructed, the adjacent destination floor representations are displayed with the width of the gap therebetween changing depending on whether those destination floors are close to each other or far from each other. Therefore, it is possible to create an impression of farness or closeness between the respective floors.

Embodiment 5

Figure 13:
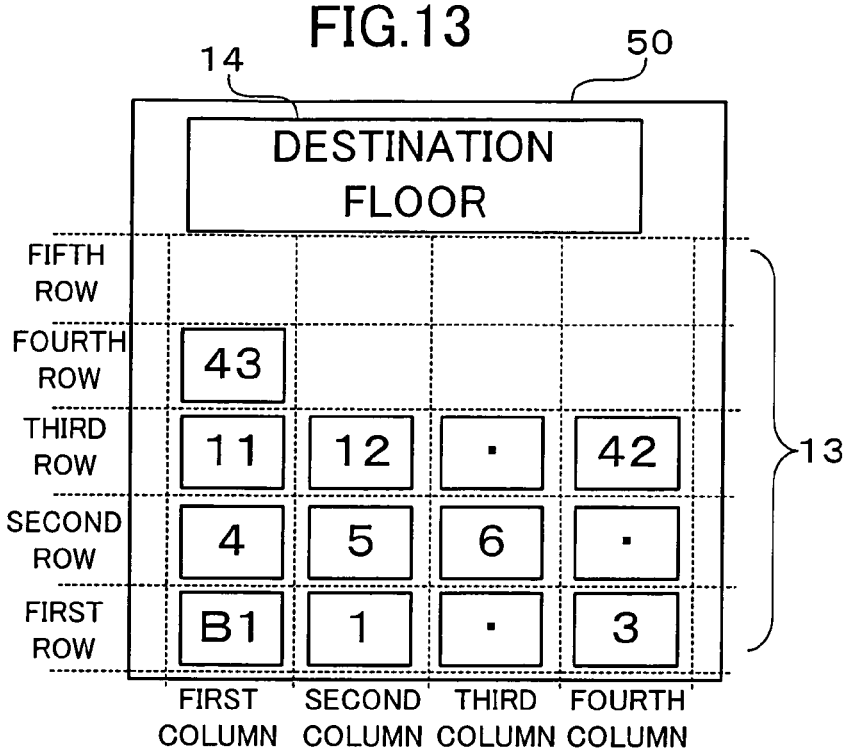
FIG. 13 is a view showing an example of destination floor representations displayed on a screen of Embodiment 5 of the present invention.

FIG. 13 is a view showing destination floor representations displayed on a screen of a destination floor display unit according to Embodiment 5 of the present invention. The destination floor display unit of Embodiment 5 is different from the destination floor display unit 1 of Embodiment 1 in the positions of destination floor representations displayed on the screen. Since the destination floor display unit of Embodiment 5 is similar to the destination floor display unit 1 of Embodiment 1 in other respects, similar components will be denoted by the same reference numerals and will not be described.

As shown in FIG. 13, destination floor representations of registered destination floors can be arranged and displayed on a screen 50 according to Embodiment 5 in five rows and four columns, as is the case with Embodiment 1. However, the destination floor representations of adjacent destination floors are displayed adjacent to each other. On the other hand, when destination floor representations of destination floors that are not adjacent to each other are displayed as adjacent destination floor representations, a representation indicating that the two floors are spaced apart from each other, for example, a rectangular graphic with a black spot in the middle as shown in FIG. 13 is displayed between the adjacent destination floor representations. For example, since floor "B1" and floor "1", floor "3" and floor "4", floor "4" and floor "5", floor "5" and floor "6", and floor "11" and floor "12" are respectively adjacent to each other, their respective destination floor representations are displayed adjacently. On the other hand, since floor "1" and floor "3", floor "6" and floor "11", and floor "12" and floor "42" are respectively not adjacent to each other, a rectangular graphic with a black spot in the middle is displayed in each space between those respective floors.

In the destination floor display unit thus constructed, when destination floor representations of two registered destination floors that are spaced apart from each other are displayed adjacently, a representation indicating that those destination floors are spaced apart from each other is displayed between those destination floor representations. Therefore, it is possible to create an impression of farness or closeness between the respective floors.

Embodiment 6

Figure 14:
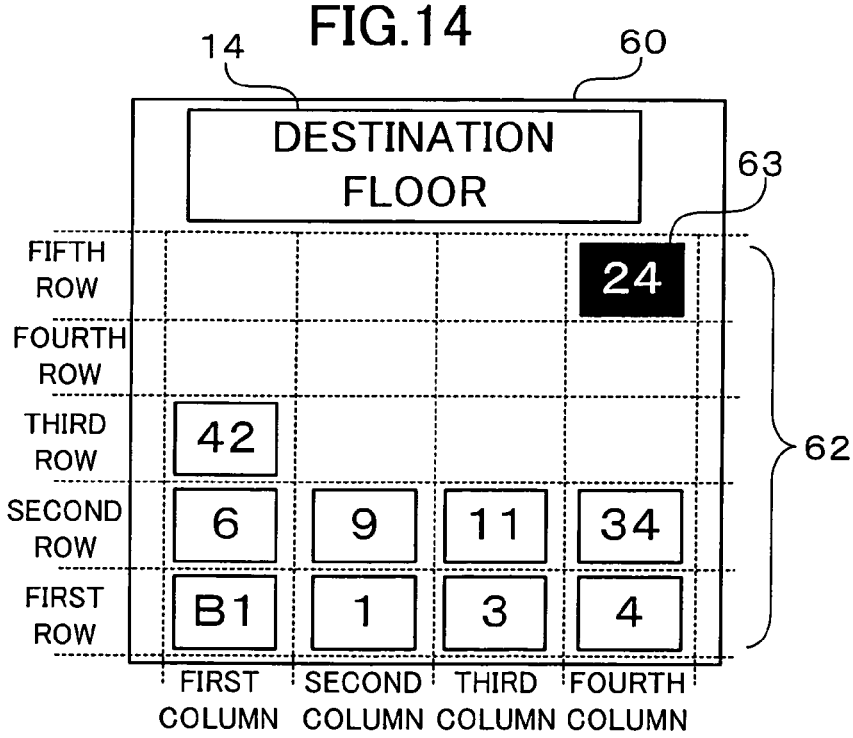
FIG. 14 is a view showing an example of a column of representations on a display portion of Embodiment 6 of the present invention.

FIG. 14 is a view showing representations on a screen of a destination floor display unit according to Embodiment 6 of the present invention. Unlike the destination floor display unit 1 of Embodiment 1, the destination floor display unit of Embodiment 6 has a screen provided with a registration display portion of a destination floor registration unit. Since the destination floor display unit of Embodiment 6 is similar to the destination floor display unit 1 of Embodiment 1 in other respects, similar components will be denoted by the same reference numerals and will not be described.

As shown in FIG. 14, destination floor representations of registered destination floors can be arranged and displayed on a screen 60 according to Embodiment 6 in five rows and four columns and in four minor destination floor display regions in the fifth row. Furthermore, a representation indicating an input number transmitted from the destination floor registration unit 11 can be displayed in a registration display portion 63 of a destination floor display region 62 of the screen 60. The representation indicating the input number is a rectangular graphic in which two numbers are depicted. The numbers have a single color, which is changed into a different color depending on a signal from the destination floor registration unit 11.

When a number is inputted by pressing a numeric key (not shown) of the destination floor registration unit, that number is displayed on the registration display portion 63. Then, when another number is inputted by pressing another numeric key, those two numbers are displayed side by side on the registration display portion 63. Then, when a numeric key used for registration is pressed, the color of the displayed numbers changes, which means that the numbers have been registered. The representation on the registration display portion 63 is deleted after the lapse of a preset time. For instance, in the case of inputting floor 24, keys for numbers "2" and "4" are sequentially pressed. When the key for the number "2" is pressed, "2" is displayed on the registration display portion 63. When the key for the number "4" is subsequently pressed, the two inputted numbers are arranged side by side to indicate "24".

The destination floor display unit thus constructed is provided with the registration display portion displaying a representation relating to a registration operation, and thus makes it possible to reduce the area of the display portion of the destination floor registration unit.

It is desirable that the destination floor registration unit and the destination floor display unit are installed adjacent to each other. This is because the line of sight needs to be greatly moved to confirm a numerical key pressed to input a number if those units are installed apart from each other. Thus, it is desirable that the destination floor registration unit, and the destination floor display unit are integrated into a single unit, which performs functions of both the units.

In Embodiments 4 and 5, even when destination floors are not adjacent to each other, a space may be inserted or a different representation may be displayed therebetween only if they are spaced apart from each other by, for example, two or more floors.

Further, when deleting a destination floor representation, those may be deleted after having blinked or after the color or brightness has changed. Alternatively, the destination floor representation may be deleted after having been gradually reduced in size or temporarily increased in size. This produces an effect of making passengers keenly aware that the elevator has stopped on the destination floor.

The invention claimed is:

1. A elevator destination floor display unit installed in a boarding area or in a passenger car of an elevator, comprising:

a display portion having a screen for selectively displaying destination floor representations related to all floors;

a display control portion that arranges and displays, in a matrix form, only destination floor representations of destination floors registered on the screen;

registered destination floor confirming means for confirming whether information on a newly registered destination floor is included in information on registered destination floors which is transmitted from an elevator control unit, and for confirming whether information on a newly de-registered destination floor is included in the information on the registered destination floors; and destination floor display position calculating means for calculating, when information on a newly registered destination floor is included, display positions of the registered destination floors on the screen in accordance with a predetermined sequence, and for calculating, when information on a newly de-registered destination floor is included, display positions of destination floor representations of registered destination floors, other than the de-registered destination floor, on the screen in accordance with a predetermined sequence so that a destination floor representation of the de-registered destination floor is deleted, wherein the display control portion displays the destination floor representations at the display positions on the screen that have been calculated.

2. The elevator destination floor display unit according to claim 1, wherein the destination floor display position calculating means calculates display positions of destination floor representations of the registered destination floors so that those destination floor representations are arranged in a lower floor to higher floor sequence or in a higher floor to lower floor sequence.

3. The elevator destination floor display unit according to claim 1, wherein the destination floor display position calculating means calculates display positions of two adjacently displayed destination floor representations such that a gap therebetween differs depending on distance between the two destination floors, related to the two destination floor representations.

4. The elevator destination floor display unit according to claim 1, wherein the display portion comprises a registration display portion that displays information related to a registered floor which is input to register a destination floor.

5. The elevator destination floor display unit according to claim 1, wherein the destination floor display position calculating means calculates display positions of two adjacently displayed destination floor representations so that a representation indicating degree of remoteness or proximity is inserted between the two destination floor representations.

6. A elevator destination floor display unit installed in a boarding area or in a passenger car of an elevator, comprising:

a display portion having a screen for selectively displaying destination floor representations related to all floors;

a display control portion that arranges and displays, in a matrix form, only destination floor representations of destination floors registered on the screen;

a touch panel sensor that is disposed in front of a screen of the display portion and, when touched, selects a destination floor representation superposed on a touched position on the screen; and registration cancellation request means for requesting the elevator control unit to cancel registration of a registered destination floor relating to a destination floor representation selected by touching the touch panel sensor.

7. The elevator destination floor display unit according to claim 6, wherein the registration cancellation request means requests the elevator control unit to cancel a registration of a registered destination floor relating to a destination floor representation selected by intermittently touching the touch panel sensor twice.

8. The elevator destination floor display unit according to claim 6, wherein the display portion comprises a registration display portion that displays information related to a registered floor which is input to register a destination floor.

* * * * *